US005729095A

United States Patent [19]

Shimokawa et al.

[11] Patent Number: 5,729,095

[45] Date of Patent: Mar. 17, 1998

[54] HIGH FREQUENCY LIGHTING APPARATUS HAVING AN INTERMEDIATE POTENTIAL APPLIED TO THE TRIGGER ELECTRODE TO REDUCE LEAKAGE CURRENT

[75] Inventors: Teiji Shimokawa, Yokohama; Akio Ishizuka, Yokosuka, both of Japan

[73] Assignee: Toshiba Lighting & Technology Corporation, Tokyo, Japan

[21] Appl. No.: 534,593

[22] Filed: Sep. 27, 1995

[30] Foreign Application Priority Data

Sep. 28, 1994 [JP] Japan ..... 6-233402

[51] Int. Cl.[6] ..... H05B 37/00

[52] U.S. Cl. ..... 315/176; 315/219; 315/DIG. 7

[58] Field of Search ..... 315/DIG. 7, 219, 315/205, 200 R, 176

[56] References Cited

U.S. PATENT DOCUMENTS

| | | | |
|---|---|---|---|
| 2,091,953 | 9/1937 | Becquemont | 176/124 |
| 3,778,677 | 12/1973 | Kriege | 315/219 |
| 3,909,666 | 9/1975 | Tenen | 315/200 R |

OTHER PUBLICATIONS

Mayer et al., Discharge Lamps, 1988, 114–115.

*Primary Examiner*—Robert Pascal
*Assistant Examiner*—Michael Shingleton
*Attorney, Agent, or Firm*—Cushman, Darby & Cushman IP Group of Pillsbury, Madison & Sutro LLP

[57] ABSTRACT

A high frequency (HF) lighting apparatus includes a rare gas discharge lamp and a power supply. The lamp has an envelope having a rare gas therein. A pair of electrodes is provided in the envelope, and an external conductor is provided near the envelope. The power supply includes a HF electric power circuit to generate a HF electric power. The HF electric power circuit has an output whose crest factor is 2.3 or more. The power supply has a ballast coupled between the HF electric power circuit and the lamp for applying stabilized HF current to the lamp. The power supply further has a DC supply circuit including a rectifier for rectifying the HF to DC and a voltage divider. The voltage divider is disposed between the lamp and the rectifier for applying a potential to the external conductor of the lamp and for adding a DC current to the stabilized HF current.

12 Claims, 4 Drawing Sheets

HIGH FREQUENCY LIGHTING APPARATUS HAVING AN INTERMEDIATE POTENTIAL APPLIED TO THE TRIGGER ELECTRODE TO REDUCE LEAKAGE CURRENT

BACKGROUND OF THE INVENTION

1. Field of the Invention

The present invention relates to a high frequency lighting apparatus suitable for a variety of applications including a liquid crystal display, or a stop signal light of a vehicle.

2. Description of the Related Art

Light sources used in a liquid crystal display device and other uses have been desired to produce high brightness with minimum size. Fluorescent lamps, one type of which includes low pressure mercury vapor discharge lamps, have been widely employed as such light sources. The fluorescent lamp has a phosphor layer coated on an inner wall of an envelope, which is necessary for converting ultra violet rays to visible light. The brightness of the visible light depends upon the mercury vapor pressure in the envelope. The mercury vapor pressure of such lamps is influenced by the ambient temperature. Accordingly, the brightness of the mercury vapor discharge lamps tends to change during lamp operation.

Recently, rare gas discharge lamps which contain rare gas instead of mercury vapor have been widely employed for various purposes. In a typical rare gas discharge lamp, xenon or neon is filled in an envelope of the lamp. Ultraviolet rays emitted by a discharge of the gas excite a phosphor coated on the envelope of the lamp to emit visible light. Because xenon or neon is less dependent on temperature than mercury, the brightness of a gas discharge lamp using such rare gas has little variation over a wide temperature range.

Although the rare gas discharge lamp avoids the change of brightness, such rare gas discharge lamp have lower brightness and require a higher starting voltage as compared to conventional fluorescent lamps.

Japanese Laid Open Patent Application No. 64-84593/1989 discloses a method for operating a rare gas discharge tamp in an attempt to mitigate the lower brightness. The rare gas discharge lamp disclosed in the application is operated with a high frequency current having a crest factor of more than 2.0, which is a ratio of a peak value to an effective value of the high frequency current applied to the lamp.

Although the brightness of the rare gas discharge lamp is increased by this method, such rare gas discharge lamps still may have other problem, including the requirement for a higher starting voltage.

In order to solve the starting voltage problem, a rare gas discharge lamp using an external conductor has been proposed. The external conductor, which is provided on an outer surface of an envelope of the discharge lamp and extended between a pair of electrodes in the envelope, functions to strengthen an electric field near the electrodes. When the lamp is operated, a localized discharge initiated between one of the electrodes and one end of the external conductor eventually reaches the other electrode, so that a full discharge between the electrodes is easily developed with a lower voltage.

Although a rare gas discharge lamp using an external conductor reduces the required starting voltage, a leakage current passes through the envelope of the lamp and increases as the diameter of the envelope becomes small. The leakage current lowers the luminous efficiency of the lamp and causes dark stripes in an illuminating region of the lamp known as striation. Japanese Laid Open Patent Application No. 58-102492/1983 discloses a power supply circuit which provides an unsymmetrical lamp current to improve the striation problem. However, the deficiencies of lower brightness and higher starting voltage are not solved by the disclosed power supply circuit.

SUMMARY OF THE INVENTION

Accordingly, an object of the present invention is to provide a high frequency lighting apparatus using a rare gas discharge lamp that reduces a starting voltage of the lamp without lowering luminous efficiency.

Another object of the invention is to provide a high frequency lighting apparatus using a rare gas discharge lamp that avoids striation without adding components to the high frequency lighting apparatus.

According to the present invention, there is provided a high frequency lighting apparatus includes a rare gas discharge lamp and a power supply. The rare gas discharge lamp has an envelope having a rare gas therein. A pair of electrodes is provided in the envelope and set apart from each other, and an external conductor is provided near the envelope.

The power supply includes a high frequency electric power circuit to generate a high frequency electric power output whose crest factor is 2.3 or more. In addition, the power supply has a ballast means coupled between the high frequency electric power circuit and the rare gas discharge lamp for applying stabilized high frequency current to the electrodes. The power supply further has a DC supply circuit. The DC supply circuit includes a rectifier for rectifying the high frequency electric power to DC power, and a voltage divider means The voltage divider means is disposed between the rare gas discharge lamp and the rectifier for applying a predetermined electric potential to the external conductor and for adding a DC current to the stabilized high frequency current.

Further in accordance with the present invention, there is provided a method for supplying power to a rare gas discharge lamp having an envelope, a pair of electrodes disposed in the envelope and an external conductor provided near the envelope. The method comprised the step of generating a high frequency electric power, having an output whose crest factor is 2.3 or more, applying a stabilized high frequency current by coupling the high frequency electric power to the electrodes through a ballast means, rectifying the high frequency electric power to DC power, applying a predetermined electric potential to the external conductor by coupling the DC power to the external conductor through a voltage divider means, and adding a direct current to the stabilized high frequency current by coupling the DC power to one of the electrodes through the voltage divider means.

These and other aspects of the invention are further described in the following drawings and detailed description of the invention.

BRIEF DESCRIPTION OF THE DRAWINGS

In the following, the present invention will be described in more details by way of examples illustrated by drawings in which.

DETAILED DESCRIPTION OF THE INVENTION

Referring now to FIG. 1 to FIG. 4, a first embodiment of the present invention will be explained.

Figure 1:
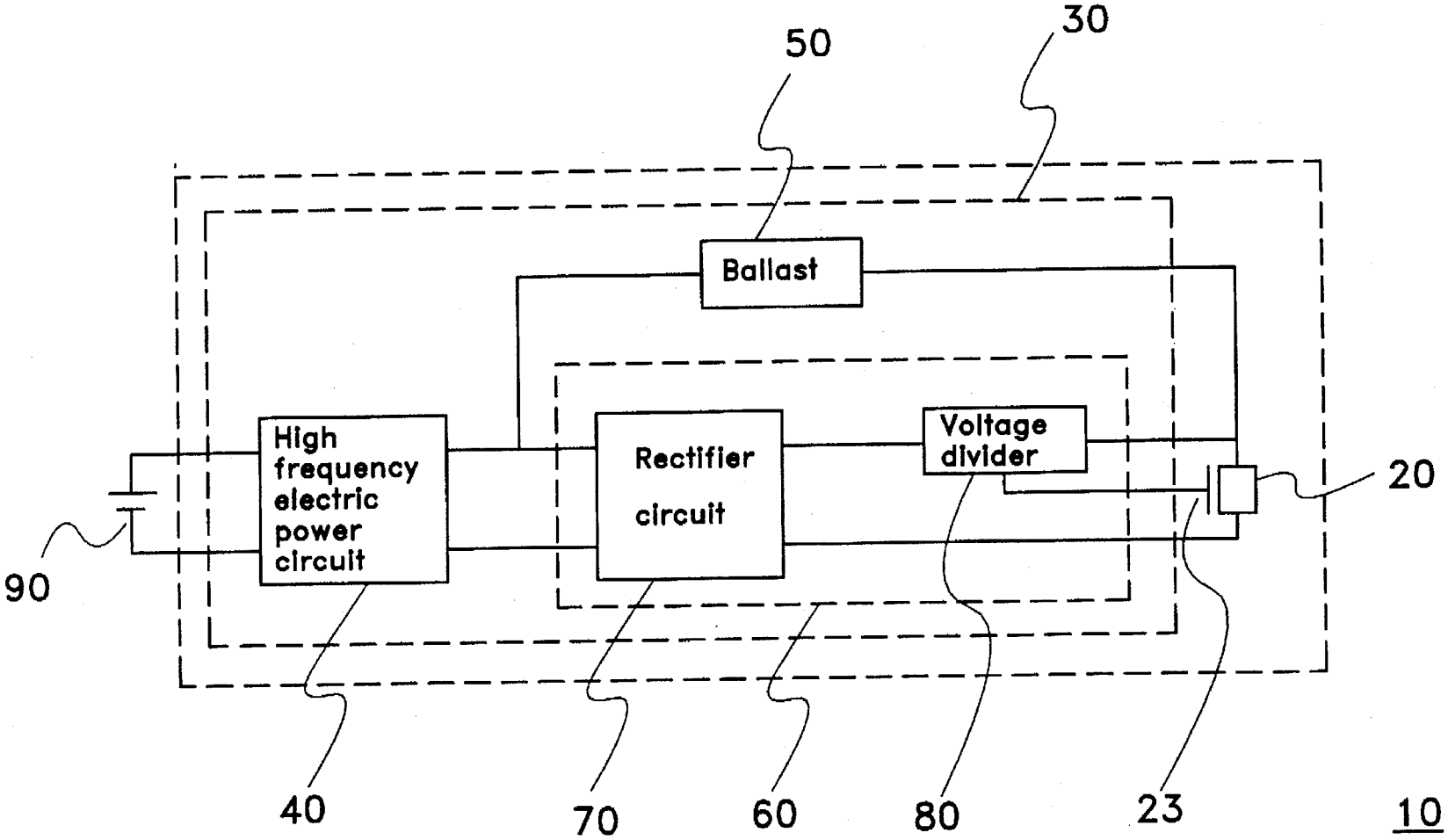
FIG. 1 is a block diagram of a high frequency lighting apparatus according to a first embodiment of the present invention.
Figure 2:
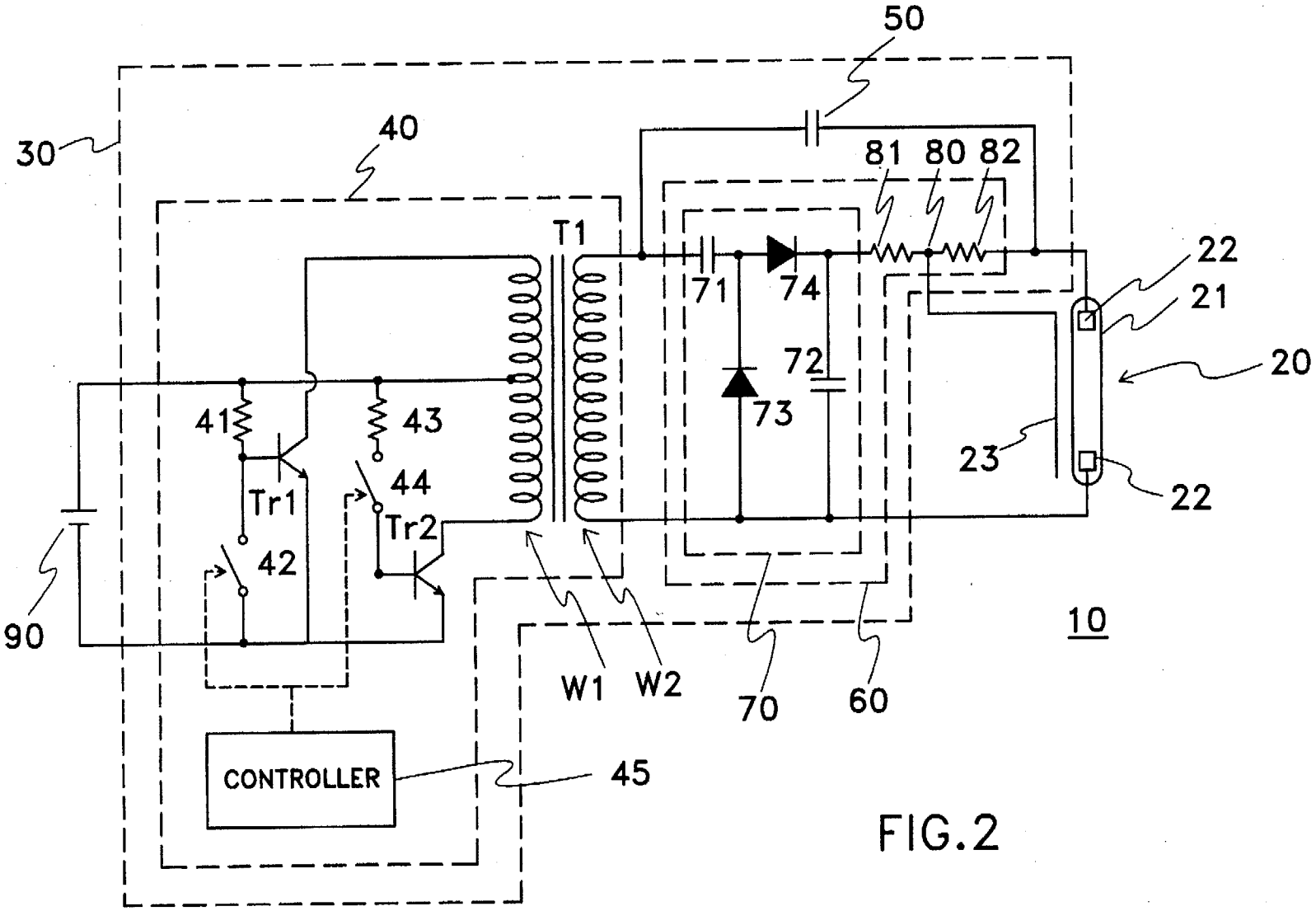
FIG. 2 is a schematic diagram of the high frequency lighting apparatus shown in FIG. 1.

FIGS. 1 and 2 show a high frequency lighting apparatus 10 according to the present invention. The high frequency lighting apparatus 10 is composed of a rare gas discharge lamp 20 and a power supply circuit 30. As shown in FIG. 2, the rare gas discharge lamp 20 includes a tubular bulb 21 or an envelope which is formed with soft glass. Neon gas as a principal filling is sealed in the bulb 21 at a pressure of about 13330 Pa (100 torr). However, other rare gas, such as xenon or a mixture of xenon and neon, may be used.

A pair of electrodes 22, 22, which serve as a cold cathode, are set apart from each other along the axis of the bulb 21. Other electrodes, such as a hot cathode, may be used. A discharge is developed between the electrodes 22, 22 when the rare gas discharge lamp 20 is operated.

In order to strengthen an electric field near the electrodes 22, 22, an external conductor 23 is mounted on an external surface of the bulb 21. In this embodiment, the external conductor 23 is made of aluminum tape having an adhesive on one surface thereof. However, other conductors, such as a printed conductive pattern, a conductive wire or a metal plate which is assembled to function as a reflector, may be used.

As shown in FIG. 1, the power supply circuit 30 includes a high frequency electric power circuit 40 for generating a high frequency electric power, a ballast 50 composed of a capacitor for stabilizing a lamp current, and a DC supply circuit 60 for providing an electric potential to the external conductor 23 and adding a DC current to the lamp current.

As shown in FIG. 2 the high frequency electric power circuit 40 is a push-pull inverter having a pair of switching transistors Tr1, Tr2 and an output transformer T1. Although the push-pull inverter is utilized in this embodiment, other type inverters may be used. Each end portion of a primary winding W1 of the transformer T1 is coupled to the collectors of the switching transistors Tr1, Tr2. The switching transistors Tr1, Tr2 have their emitters coupled to a negative pole of a DC power source 90. The DC power source 90 in this embodiment is a battery, however, it may be formed with a conventional rectifying circuit.

The base of the switching transistor Tr1 is connected to a junction point of a series circuit formed with a resistor 41 and a switch device 42. The base of the other switching transistor Tr2 is connected to a series circuit formed with a resistor 43 and a switch device 44.

A positive pole of the DC power source 90 is coupled to an intermediate tap of the primary winding W1 of the transformer T1. The switch devices 42 and 44 are coupled to a controller 45 formed with a pulse generator. The controller 45 generates a train of pulses of which pulse width is varied.

The switch devices 42 and 44 are closed in response to the controller 45 outputting a high level of the pulses. The switch devices 42 and 44 are opened when the controller 45 outputs a low level of the pulses.

When the switch devices 42 and 44 are closed (ON), the base potential of the switching transistor Tr1 becomes low to turn off the switching transistor Tr1. On the other hand, the base potential of the switching transistor Tr2 becomes high to turn on the switching transistor Tr2.

When the switch devices 42 and 44 are opened (OFF), the base potential of the switching transistor Tr1 becomes high to turn on the switching transistor Tr1. On the other hand the base potential of the switching transistor Tr2 becomes low to turn off the switching transistor Tr2. Such operations are repeated as long as the controller 45 generates pulses, and the high frequency electric power provided by circuit 40 is derived from the secondary winding W2 of the transformer T1.

One end of the ballast 50 is connected to one end of the secondary winding W2, while the other end of the ballast 50 is connected to one electrode 22 of the rare gas discharge lamp 20.

The DC supply circuit 60 which is composed of a rectifier circuit 70 and a voltage divider 80, is disposed between the secondary winding W2 of the transformer T1 and the rare gas discharge lamp 20. The rectifier circuit 70 is a typical voltage multiplying rectifier formed with capacitor 71, capacitor 72 operating as a smoothing capacitor and diodes 73, 74, which outputs a DC voltage higher than a peak value of the high frequency voltage derived from the secondary winding W2 of the transformer T1.

The voltage divider 80 is formed with two serially connected resistors 81, 82, which is disposed between one output terminal of the rectifier circuit 70 and one electrode 22 of the rare gas discharge lamp 20. A junction point of the resistors 81, 82 is connected to the external conductor 23 for providing a DC potential to the external conductor 23. Each impedance of the resistors 81, 82 is so selected that the DC potential of the external conductor 23 is kept at a value between the potentials developed on the respective electrodes 22, 22.

When the operation of the high frequency electric power circuit 40 is started, the DC potential is applied to the external conductor 23. Therefore, an electrical field near the electrode 22 is strengthened to promote a localized discharge between one of the electrodes 22 operated as a cathode and the external conductor 23. At the same time, the output DC voltage of the rectifier 70 is applied to the electrodes 22, 22 of the rare gas discharge lamp 20.

Accordingly, the localized discharge eventually reaches the other electrode 22, so that a full discharge between the electrodes 22, 22 is developed. As a result, a reduced lamp starting voltage and lamp starting time can be achieved.

After the rare gas discharge lamp 20 is ignited, a closed looped circuit composed of the ballast 50, the rare gas discharge lamp 20 and secondary winding W2 is formed. A composite impedance of the DC supply circuit 60 is designed to be larger than that of the ballast 50 after the rare gas discharge lamp 20 is ignited, so that the high frequency current flowing through the ballast 50 is greater than the DC current supplied to the rare gas discharge lamp 20 from the DC supply circuit 60. The lamp current becomes a total current of the high frequency current flowing through the ballast 50 and the DC current supplied from the DC supply circuit 60, whereby the lamp current becomes unsymmetrical.

Accordingly, striations becomes inconspicuous, because dark stripes in an illuminating region of the rare gas discharge lamp 20 move at high velocity.

Therefore, the power supply circuit 30 prevents striations without adding componentry to the circuit, thereby avoiding increased cost and size of the apparatus.

Next, a characteristic between the crest factor of the high frequency electric power supplied to the rare gas discharge lamp 20 and a brightness of the rare gas discharge lamp 20 will be described.

The crest factor is the maximum ratio among those ratios of the peak voltage to an effective voltage of the high frequency electric power during each cycle. In the embodiment, the effective voltage of the high frequency electric power is selectively varied by changing the pulse width of the pulses generated by the controller 45. The crest factor depends on the effective voltage of the high frequency electric power, therefore it is changed by varying the pulse width of the pulses.

Table I shows relationships between a crest factor of the high frequency electric power and a relative brightness for a xenon gas discharge lamp and a neon gas discharge lamp. The relative brightness of a lamp is a ratio of an actual brightness of a lamp to a reference brightness of a reference lamp when both lamps are operated with a sinusoidal wave or 1.4 crest factor.

The xenon gas discharge lamp and the neon gas discharge lamp are each filled with xenon gas and neon gas in an envelope having a 10 mm outer diameter and 330 mm length.

TABLE I

| Crest factor | Relative brightness of the xenon gas discharge lamp (Point) | Relative brightness of the neon gas discharge lamp (Point) |
|---|---|---|
| 1.16 | 0.98 (A1) | 1.03 (A2) |
| 1.40 | 1.00 (B1) | 1.00 (B2) |
| 1.80 | 0.95 (C1) | 0.90 (C2) |
| 2.00 | 0.98 (D1) | 0.95 (D2) |
| 2.10 | 0.98 (E1) | 1.00 (E2) |
| 2.30 | 1.02 (F1) | 1.04 (F2) |
| 2.59 | 1.05 (G1) | 1.09 (G2) |
| 2.81 | 1.07 (H1) | 1.11 (H2) |

Figure 3:
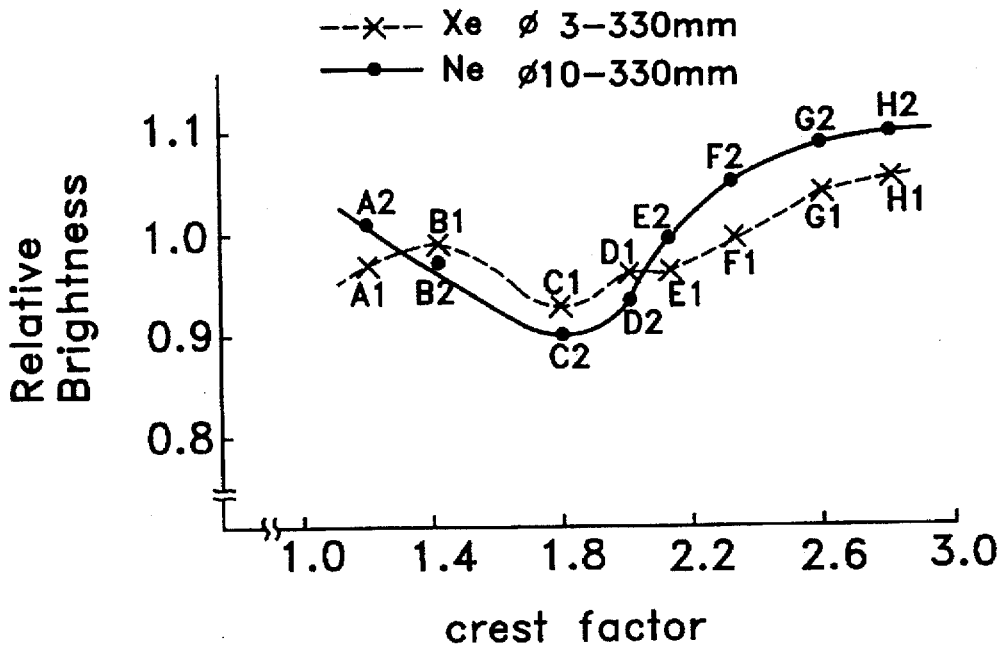
FIG. 3 is a graph showing the relationship between a relative brightness of rare gas discharge lamps and a crest factor of high frequency electric power applied to the lamps.

As shown in FIG. 3, the relative brightness of each lamp has a minimum value when the crest factor is about 1.8. The relative brightness of each lamp gradually increases when the crest factor exceeds 1.8. The relative brightness of both lamps exceeds 1.0 when the crest factor is 2.3 or more. Accordingly, in order to obtain higher brightness than that of the reference lamp, the crest factor is preferably selected to be 2.3 or more.

The following Table II shows the relationship between an operating frequency and relative luminous efficacy of the neon gas discharge lamp. The relative luminous efficacy is a ratio of actual luminous efficacy of the neon gas discharge lamp to the efficacy obtained in a reference lamp when both lamps are operated at 33 KHz.

TABLE II

| Operating frequency (Point) | Relative luminous efficacy |
|---|---|
| 24 KHz (A) | 0.96 |
| 33 KHz (B) | 1.00 |
| 43 KHz (C) | 1.10 |
| 55 KHz (D) | 1.09 |
| 71 KHz (E) | 1.02 |

TABLE II-continued

| Operating frequency (Point) | Relative luminous efficacy |
|---|---|
| 80 KHz (F) | 0.81 |
| 90 KHz (G) | 0.61 |

Figure 4:
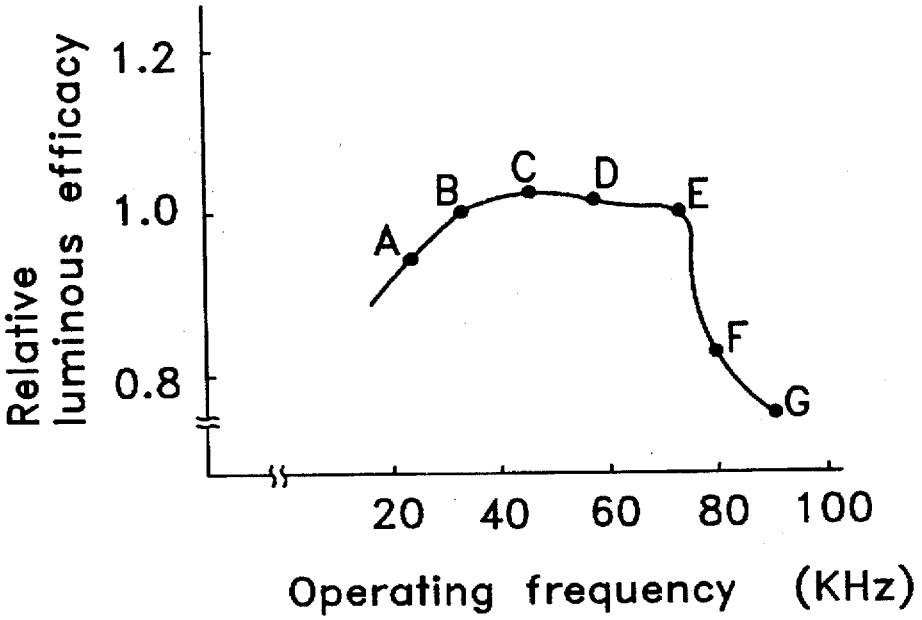
FIG. 4 is a graph showing the relationship between a relative brightness of a neon gas discharge lamp and a frequency of high frequency electric power applied to the neon gas discharge lamp.

FIG. 4 is a graph of the data in the Table II. As shown in FIG. 4, the relative luminous efficacy of the neon gas discharge lamp is maintained at more than 1.0 if the operating frequency is kept in the range of 33 KHz to 71 KHz. The relative luminous efficacy of the neon gas discharge lamp rapidly drops when the operating frequency exceeds 71 KHz. Accordingly, the operating frequency of the high frequency electric power circuit 40 is preferably maintained between 33 KHz ~71 KHz.

Figure 5:
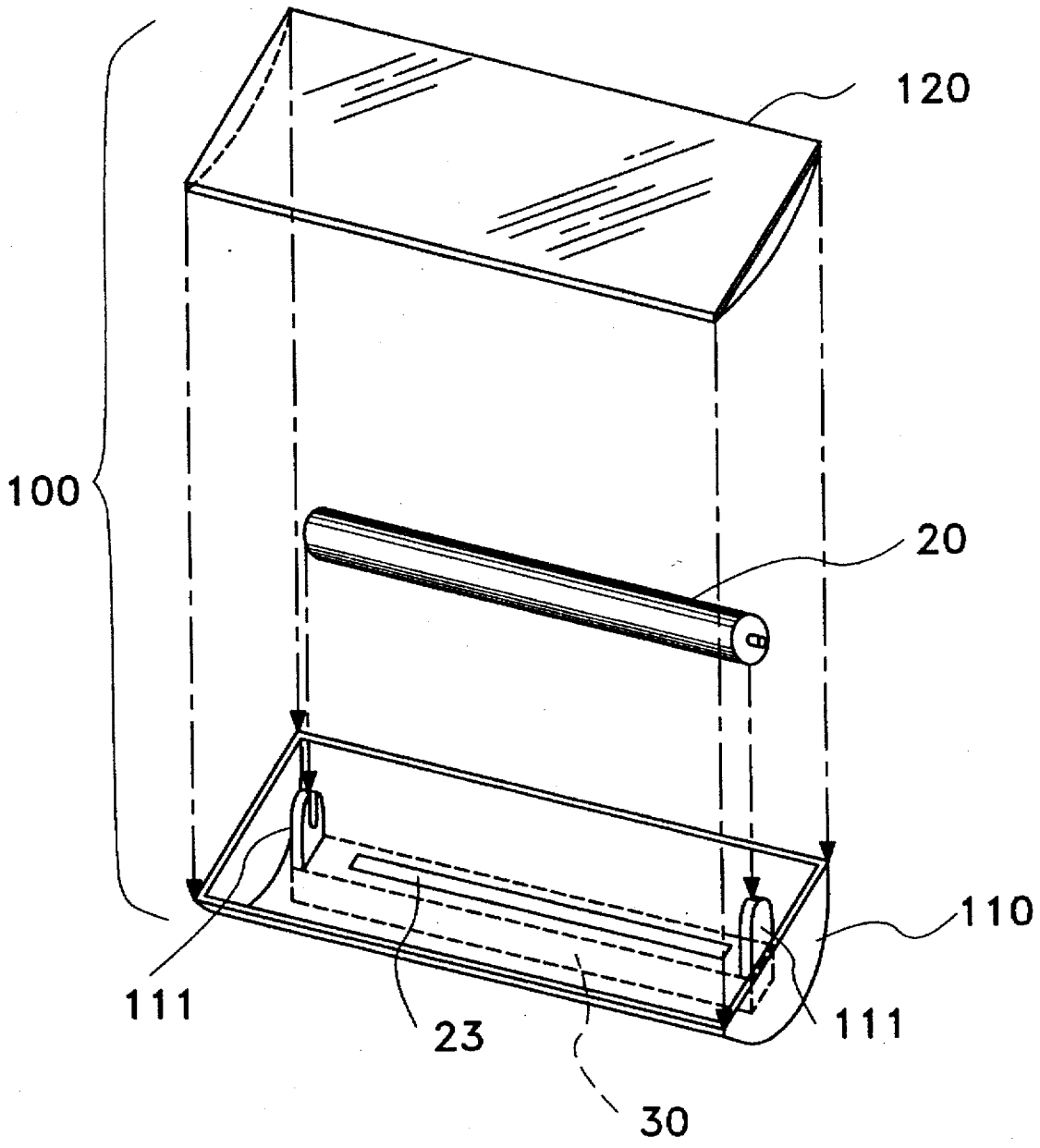
FIG. 5 is an exploded perspective view of a high frequency lighting apparatus according to a second embodiment of the present invention.

Another embodiment in accordance with the present invention is shown in FIG. 5 and explained next. Like reference characters designate identical or corresponding elements of the above described first embodiment. The construction and operation of the following embodiment is substantially the same as the first embodiment and, therefore, a detailed explanation of its operation is not provided.

FIG. 5 shows a high frequency lighting apparatus 100 used for a liquid crystal display (not shown), which is assembled with the rare gas discharge lamp 20, the power supply circuit 30, a luminaire 110 serving as a reflector and a light diffusive translucent plate 120. The luminaire 110 is a U-shaped aluminum plate extending substantially over the whole length of the lamp 20. The rare gas discharge lamp 20 is mounted on sockets 111, 111 and arranged at a focal point of the luminaire 110. The external conductor 23 is located on an inner surface of the luminaire 110. The light diffusive translucent plate 120, which is made of a milky-white color resin such as acrylic acid resin, is disposed on a front opening of the luminaire 110 so that the light diffusive translucent plate 120 transmits diffused light. The power supply circuit 30 shielded by a case (not shown) is provided on a rear portion of the luminaire 110.

Such high frequency lighting apparatus 100 is not only useful for a liquid crystal display but also for other applications according to their purposes.

While the invention has been described in connection with what are presently considered to be the most practical and preferred embodiments, it is to be understood that the invention is not limited to the disclosed embodiments. On the contrary, it is intended to cover various modifications and equivalent arrangements included within the spirit and scope of the appended claims.

What is claim is:

1. A power supply for a rare gas discharge lamp having an envelope, a pair of electrodes disposed in said envelope and an external conductor provided near said envelope, comprising:

a high frequency electric power circuit to generate a high frequency electric power, having an output whose crest factor is 2.3 or more;

a ballast means coupled between said high frequency electric power circuit and said rare gas discharge lamp for applying stabilized high frequency current to said electrodes; and a DC supply circuit including a rectifier for rectifying said high frequency electric power to DC power, and a voltage divider means disposed between said rare gas discharge lamp and said rectifier for applying a predetermined electric potential to said external conductor, said predetermined electric potential being maintained by said voltage divider at an intermediate potential between potentials of said electrodes, and for adding a direct current to said stabilized high frequency current.

2. A high frequency lighting apparatus using a rare gas discharge lamp, comprising:

a rare gas discharge lamp including:

an envelope having a rare gas therein, a pair of electrodes provided in said envelope and set apart from each other, and an external conductor provided near said envelope; a power supply including:

a high frequency electric power circuit to generate a high frequency electric power, having an output whose crest factor is 2.3 or more, a ballast means coupled between said high frequency electric power circuit and said rare gas discharge lamp for applying stabilized high frequency current to said rare gas discharge lamp, and a DC supply circuit including a rectifier for rectifying said high frequency electric power to DC power, and a voltage divider means disposed between said rare gas discharge lamp and said rectifier for applying a predetermined electric potential to said external conductor, said predetermined electric potential being maintained by said voltage divider at an intermediate potential between potentials of said electrodes, and for adding a direct current to said stabilized high frequency current.

3. A high frequency lighting apparatus according to claim 2, said rectifier further including a smoothing capacitor.

4. A method for supplying power to a rare gas discharge lamp having an envelope, a pair of electrodes disposed in said envelope and an external conductor provided near said envelope, comprising the step of:

generating a high frequency electric power, having an output whose crest factor is 2.3 or more;

applying a stabilized high frequency current by coupling said high frequency electric power to said electrodes through a ballast means;

rectifying said high frequency electric power to DC power;

applying a predetermined electric potential to said external conductor by coupling said DC power to said external conductor through a voltage divider means, said predetermined electric potential being maintained by said voltage divider means at an intermediate potential between potentials of said electrodes; and adding a direct current to said stabilized high frequency current by coupling said DC power to one of said electrodes through said voltage divider means.

5. A high frequency lighting apparatus according to claim 2, said rectifier including means for generating a higher voltage than a voltage received from the high frequency electric power circuit.

6. A high frequency lighting apparatus according to claim 5, said rectifier comprising a voltage multiplying rectifier circuit.

7. A high frequency lighting apparatus according to claim 2, said rare gas including xenon, neon, or a mixture thereof.

8. A high frequency lighting apparatus according to claim 7, said high frequency electric power circuit including means for controlling a frequency of the high frequency electric power between a minimum frequency of 33 KHz and a maximum frequency of 71 KHz.

9. A high frequency lighting apparatus according to claim 7, wherein said pair of electrodes are for operation as a cold cathode.

10. A high frequency lighting apparatus according to claim 9, said ballast means including a capacitor.

11. A high frequency lighting apparatus according to claim 9, said rare gas discharge lamp having a cylindrical shape with an outer diameter not exceeding 10 mm.

12. A high frequency lighting apparatus according to claim 2, further including a luminaire for housing said rare gas discharge lamp.

* * * * *